US006651901B2

(12) United States Patent
Jones

(10) Patent No.: US 6,651,901 B2
(45) Date of Patent: Nov. 25, 2003

(54) MISTING SYSTEM NOZZLE HOLDER WITH MANUAL SLIDE SHUT-OFF VALVE

(75) Inventor: Paul C. Jones, Island Lake, IL (US)

(73) Assignee: Corrigan Corporation of America, Gurnee, IL (US)

( * ) Notice: Subject to any disclaimer, the term of this patent is extended or adjusted under 35 U.S.C. 154(b) by 98 days.

(21) Appl. No.: 09/812,667

(22) Filed: Mar. 20, 2001

(65) Prior Publication Data

US 2002/0134854 A1 Sep. 26, 2002

(51) Int. Cl.[7] ..... B05B 1/08

(52) U.S. Cl. ..... 239/99; 239/583; 239/579; 239/541; 239/455; 251/340

(58) Field of Search ..... 239/99, 242, 583, 239/575, 579, 537–541, 455–457; 169/90; 251/340, 145; 137/883

(56) References Cited

U.S. PATENT DOCUMENTS 68,478 A * 9/1867 Allen ..... 251/340
2,630,999 A * 3/1953 Lee ..... 251/145
2,913,232 A * 11/1959 Silverman ..... 239/380
2,945,628 A * 7/1960 Broughton ..... 239/264
4,848,403 A * 7/1989 Pilolla et al. ..... 251/340
5,441,202 A * 8/1995 Wintering et al. ..... 239/267
5,742,961 A * 4/1998 Casperson et al. ..... 239/583
6,135,356 A * 10/2000 Mitzlaff et al. ..... 239/240

* cited by examiner

*Primary Examiner*—Michael Mar
*Assistant Examiner*—Dinh Q. Nguyen
(74) *Attorney, Agent, or Firm*—Wood, Phillips, Katz, Clark & Mortimer

(57) ABSTRACT

A misting system valve assembly comprises a conduit connectable to a pressurized fluid supply. The conduit includes a through opening. A sleeve is telescopically received on the conduit. The sleeve is adapted to support a nozzle. The sleeve has a sleeve opening therethrough for selectively delivering pressurized fluid to the nozzle. The sleeve is moveable on the conduit between an open position where the conduit through opening is in communication with the sleeve opening and a closed position where the conduit through opening is not in communication with the sleeve opening.

24 Claims, 5 Drawing Sheets

MISTING SYSTEM NOZZLE HOLDER WITH MANUAL SLIDE SHUT-OFF VALVE

BACKGROUND OF THE INVENTION

This invention relates to misting systems and in particular to a misting system nozzle holder with a manual slide shut-off valve.

One conventional form of misting system used in providing misting spray onto produce and the like comprises an assembly wherein misting nozzles are in continuous open communication with a liquid supply inlet. In such systems, prevention of the delivery of the misting spray requires either the delivery to the assembly be discontinued, or that the nozzles be removed and replaced with a closure plug, or the nozzles be removed, provided with a closure plug internally thereof, and reinstalled so that the installed closure plug prevents further flow therethrough.

Other misting systems permit facilitated shut-off of selected misting heads as desired by incorporating a valve into the misting head. One exemplary system mounts a nozzle to a swivel arm on a cylindrical rotor. Flow can be selectively provided to an individual nozzle by rotating the swivel arm about the cylindrical rotor.

SUMMARY OF THE INVENTION

In accordance with the invention there is provided a misting system valve assembly using a manual slide shut-off valve.

Broadly, there is disclosed herein a misting system valve assembly comprising a conduit connectable to a pressurized fluid supply, the conduit including a through opening. A sleeve is telescopically received on the conduit. The sleeve is adapted to support a nozzle. The sleeve has a sleeve opening therethrough for selectively delivering pressurized fluid to the nozzle. The sleeve is moveable on the conduit between an open position where the conduit through opening is in communication with the sleeve opening and a closed position where the conduit through opening is not in communication with the sleeve opening.

It is a feature of the invention that the conduit and sleeve are cylindrical.

It is another feature of the invention to provide an annular outwardly opening groove in the conduit and the conduit through opening opens into the groove.

It is still another feature of the invention to provide a pair of O-rings disposed on the conduit on either side of the through opening.

It is still another feature of the invention to provide stop means for limiting axial movement of the sleeve on the conduit. The stop means may comprise retaining clips mounted to the conduit on opposite sides of the through opening.

It is still a further feature of the invention to provide stop means for limiting rotary movement of the sleeve on the conduit. The stop means may comprise an element protruding outwardly from the conduit and receivable in an axially extending groove in the sleeve. The element may comprise a ball bearing receivable in a depression in the conduit.

It is still a further feature of the invention that the sleeve includes an adaptor extending radially therefrom for removably receiving a nozzle.

Further features and advantages of the invention will be readily apparent from the specification and from the drawings.

DETAILED DESCRIPTION OF THE INVENTION

Figure 1:
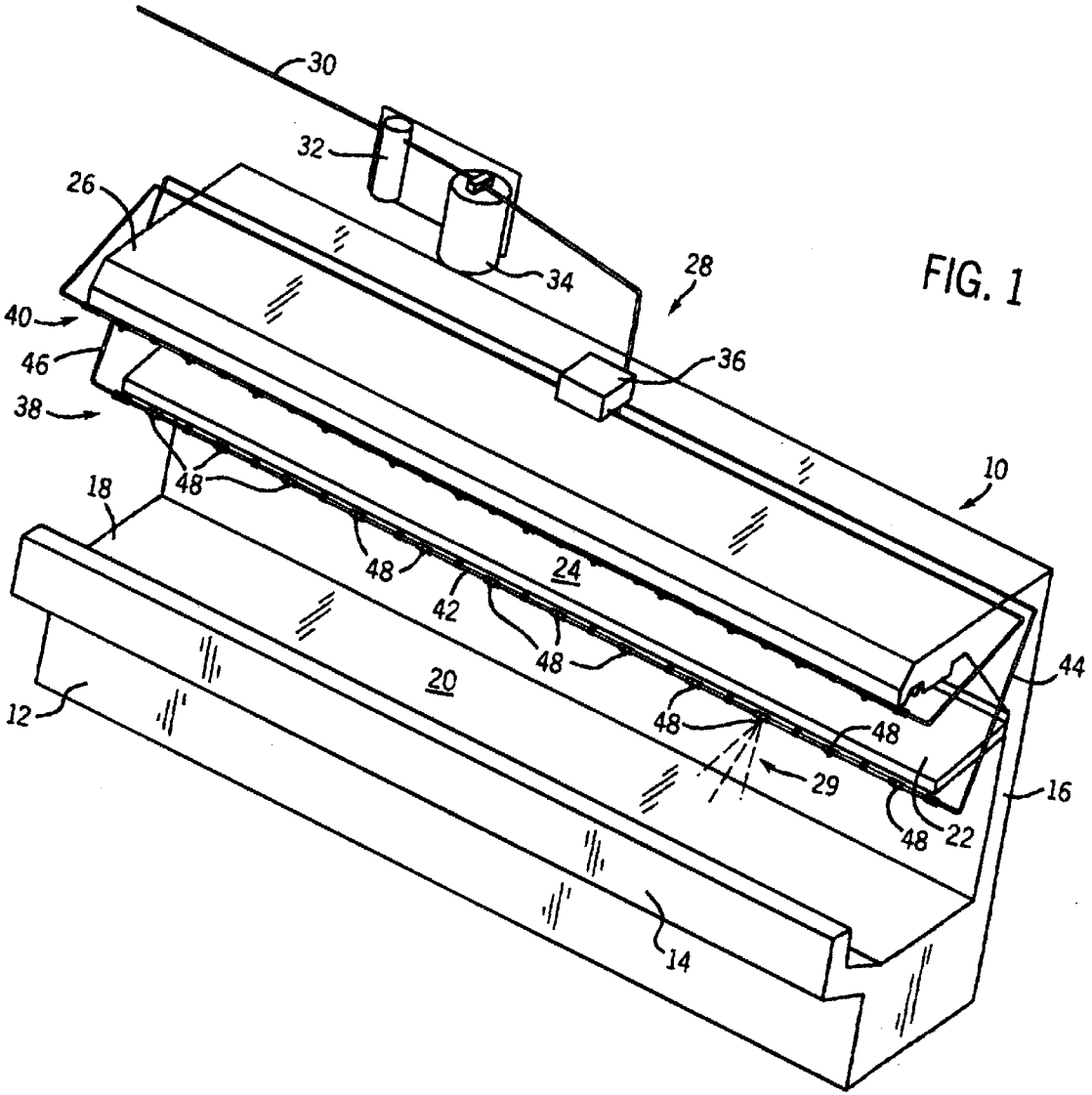
FIG. 1 is a perspective view of a misting system in accordance with the invention mounted in a display case.

Referring initially to FIG. 1, a display case, such as a produce case 10 includes a base 12 connected to a relatively short upstanding front wall 14 and a taller upstanding rear wall 16. A bottom shelf 18 is disposed between the front wall 14 and the rear wall 16 to define a lower produce space 20. A shelf 22 extends forwardly from the rear wall 16 above the bottom wall 18 to define an upper storage space 24. A top 26 extends forwardly atop the rear wall 16 above the shelf 22.

The lower storage space 20 and upper storage space 24 are used to store produce or the like, such as fruits and vegetables. The invention comprehends providing for use with such a produce case 10 a misting system generally designated 28 adapted to selectively provide for a fine mist 29 downwardly into the storage spaces 20 and 24. The invention comprehends misting system nozzle holders with manual slide shut-off valves as described more particularly below.

The misting system 28 may be connected to a conventional pressurized fluid supply via a conduit 30. The supply may be a conventional municipal water supply. The conduit 30 is connected through a sediment filter 32 to an accumulator 34 and to a control box 36. The control box 36 includes a pair of valves (not shown) for selectively providing pressurized water supply to a lower zone 38 associated with the lower storage space 20 and an upper zone 40 associated with the upper storage space 24.

The lower zone 38 comprises an elongate conduit 42 connected at its opposite ends via lines 44 and 46 to the control box 36. A plurality of nozzle holders 48 are mounted to the conduit 42. In the illustrated embodiment of the invention, there are twelve nozzle holders 48 to provide overlapping misting to ensure complete coverage of the lower storage space 20.

The upper zone 40 is generally similar to the lower zone 38, and it is therefore not described in detail herein.

In accordance with the invention, each nozzle holder 48 includes a manual slide shutoff valve as will now be described.

Figure 2:
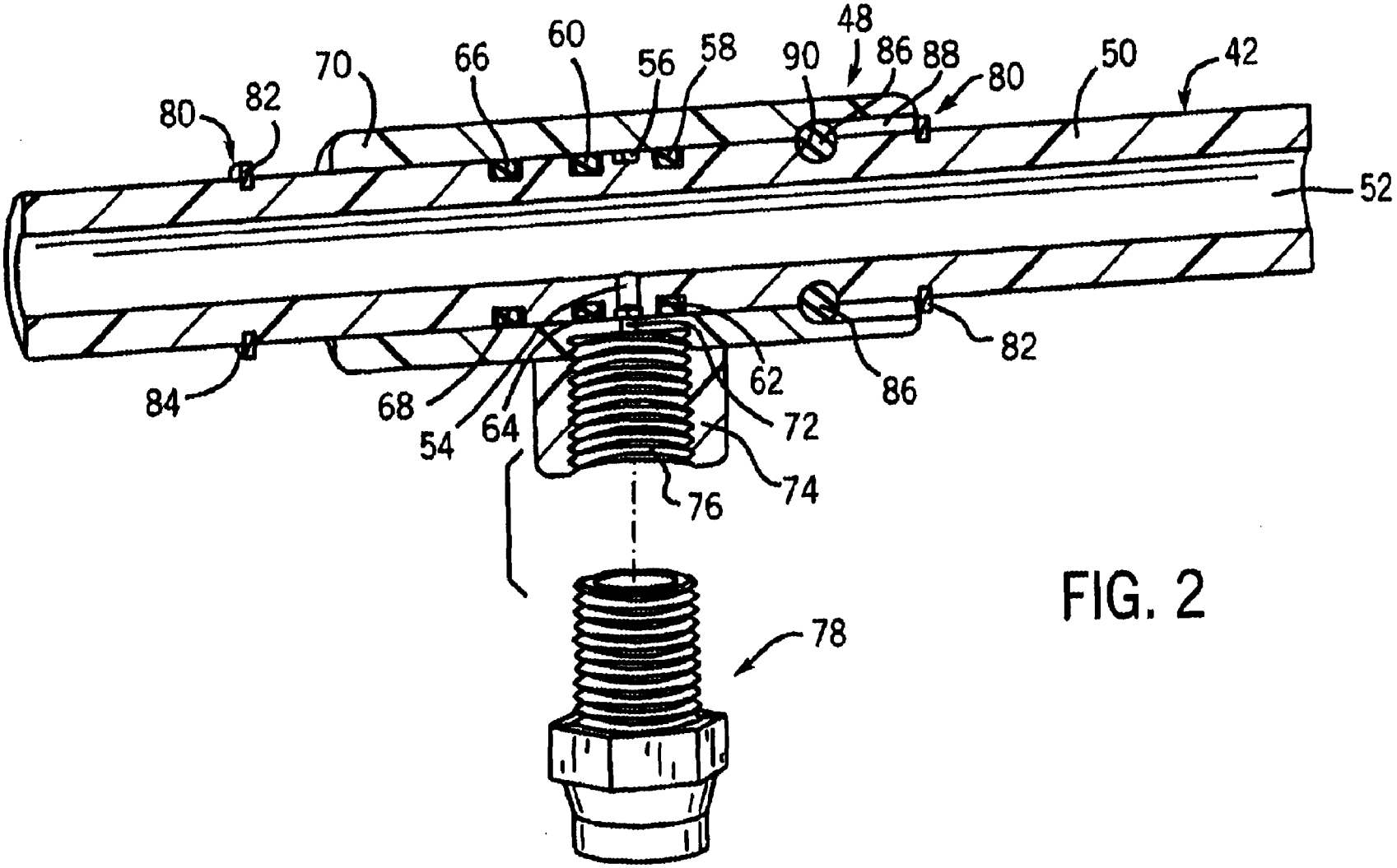
FIG. 2 is a sectional view of a misting system valve assembly in accordance with the invention.

Referring to FIG. 2, an exemplary nozzle holder 48 is illustrated.

The conduit 42 comprises a tubular or cylindrical conduit. The conduit 42 and nozzle holder 48 may be of, for example, polyvinyl chloride (PVC) construction. As will be apparent, other materials could also be used. The conduit 42 includes a tubular wall 50 enclosing a cylindrical passageway 52. The conduit 42 includes the following structural elements associated with each of the plurality of nozzle holders 48. A through opening 54 extends through the tubular wall 50 and opens into an outwardly opening annular groove 56. A first O-ring 58 and a second O-ring 60 are received in annular grooves 62 and 64, respectively, longitudinally spaced from the groove 56. The first and the second grooves 62 and 64 are on opposite sides of the groove 56. A third O-ring 62 is received in an annular groove 68. Particularly, the second O-ring 66 is centrally located between the first O-ring 56 and the third O-ring 66.

The nozzle holder 48 comprises a sleeve 70 telescopically received on the conduit 42 so that it is slidably moveable on the conduit 42. The sleeve 70 includes a through opening 72 opening into an adaptor 74 extending radially from the sleeve 70. The adaptor 74 is cylindrical and includes an inner threaded surface 76 for threadably receiving a nozzle 78.

In accordance with the invention, the nozzle holder 48 operates as a slide shut-off valve by manually moving the sleeve 70 in one direction to turn water to the nozzle 78 on and in the opposite direction to turn water off. The outer sleeve 70 and conduit 42 can be of various shapes and sizes. Likewise, the nozzle adaptor 74 may have different thread sizes or utilize different nozzle holding techniques to accept different nozzle styles. In fact, the nozzle could be an integral element of the nozzle holder.

Pressurized water is carried through the conduit passageway 52 to each nozzle holder location. When the through opening 72 on the outer sleeve is manually moved between the first and second O-rings 58 and 60 and in longitudinal alignment with the conduit opening 54, water is transferred to the misting nozzle 78. When the sleeve through opening 72 is manually moved between the second O-ring 60 and the third O-ring 66 the water transfer to the misting nozzle 78 is stopped. By using the annular groove 56, the sleeve 70 can be rotated to any position and still provide water flow. This allows the nozzle holder 48 to be swivelled to different positions to provide coverage in different areas of the storage space 20.

To limit axial movement of the nozzle holder 48 on the conduit 42, stops 80 are provided on opposite sides of the conduit opening 54. The stops 80 comprise retaining clips 82 received in annular grooves 84 in the conduit 42. In the illustration of FIG. 2, the rightmost stop 80 is positioned to abut the sleeve 70 when the valve is in the open position. The leftmost stop 80 is positioned to abut the sleeve 70 when the valve is in the off position with the sleeve opening 72 between the second O-ring 60 and the third O-ring 66.

If desired to stop the nozzle holder 48 from swivelling on the conduit 42, one or more ball bearings 86 may be positioned between an axially extending groove 88 on the inside wall of the sleeve 70 and an outwardly opening cup-shaped depression 90 in the conduit 42. Particularly, the ball bearing 90 permits the sleeve 70 to move axially, but stops the sleeve 70 from rotating. As is apparent, if a swivel operation is desired for the nozzle holder 48, then the ball bearings 86 can be removed or eliminated.

The misting system 28 may comprise any number of nozzle holders 48 from one on up. The number of nozzle holders used would depend on the size of the storage space and available fluid supply. Therefore, as few as a single nozzle holder 48 can be placed on the conduit 42 or plural nozzle holders 48 can be used, as illustrated in FIG. 1, on the same conduit 42.

FIG. 2 illustrates the conduit 42 at a single sleeve location. The conduit 42 is similarly configured at each of the other nozzle locations so that each nozzle holder operates independently of one another.

Figure 3:
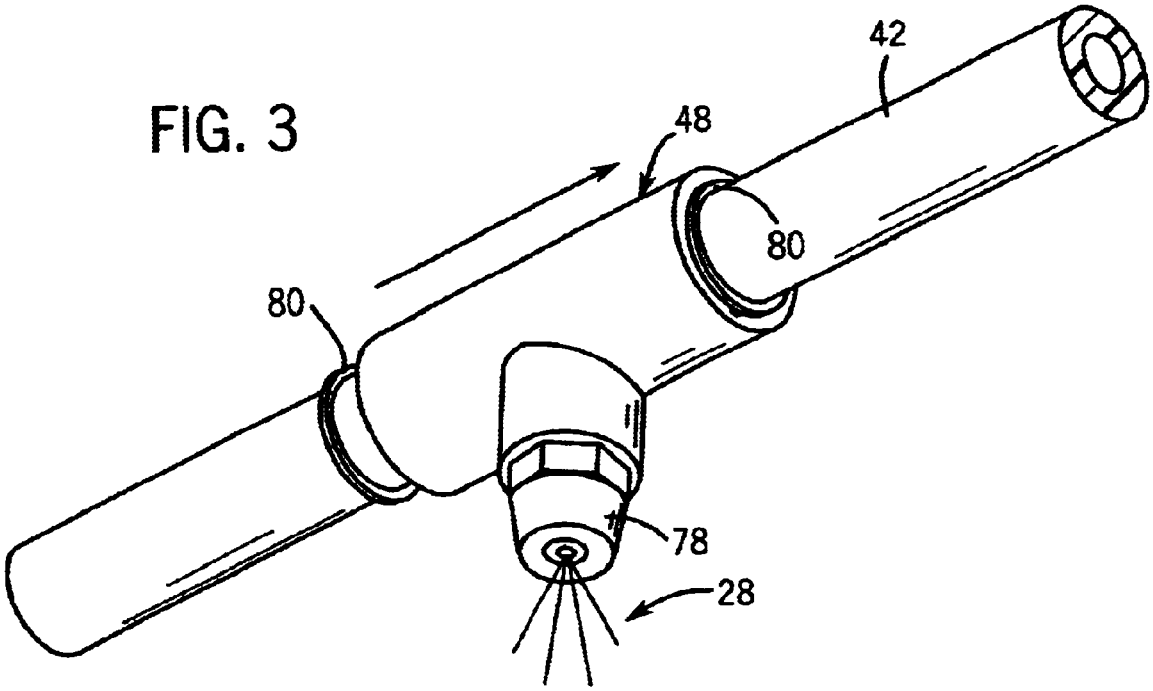
FIG. 3 is a perspective view of the misting system valve assembly of FIG. 2 in an open position.
Figure 4:
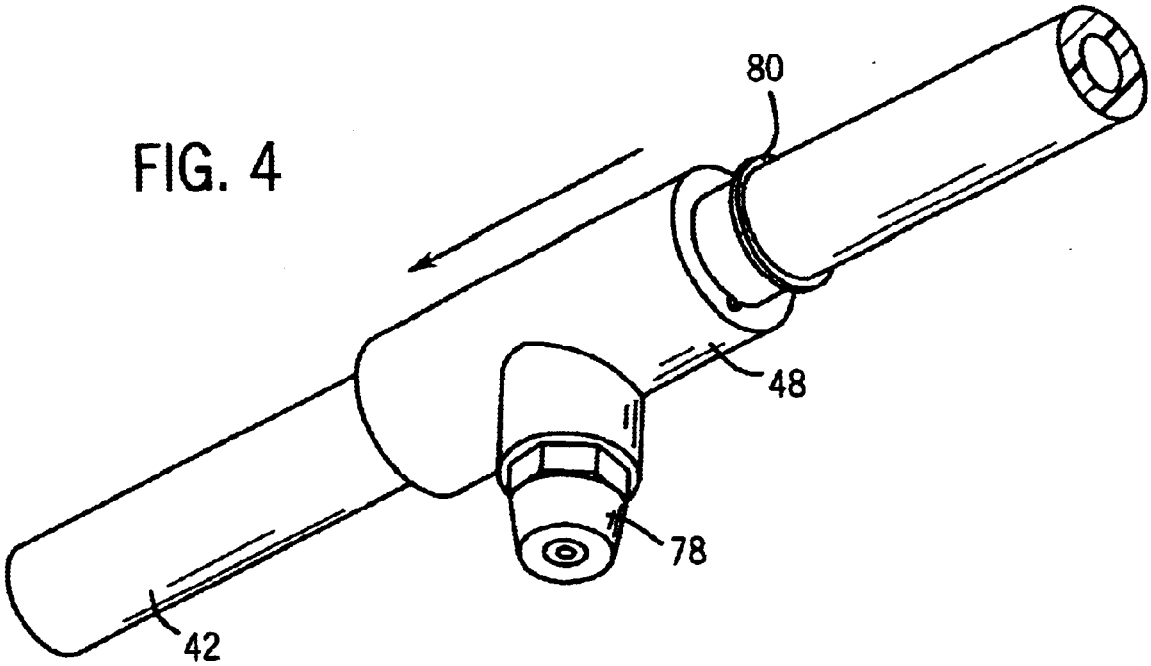
FIG. 4 is a perspective view of the misting system valve assembly of FIG. 2 in a closed position.

Referring to FIGS. 3 and 4, operation of the nozzle holder is illustrated. When the nozzle holder 48 is moved to the rightmost position, as illustrated in FIG. 3, the valve is in the on position so that mist 29 is provided from the nozzle 78. Conversely, when the nozzle holder 48 is moved to the left, as illustrated in FIG. 4, the valve is in the closed position so that water to the valve 78 is shut off. The first O-ring 58 and the second O-ring 60, see FIG. 2, prevent water from leaking when the valve is in the on position. Similarly, the second O-ring 60 and the third O-ring 66 prevent water from the nozzle 78 from returning back into the conduit 42 in the off position.

Figure 5:
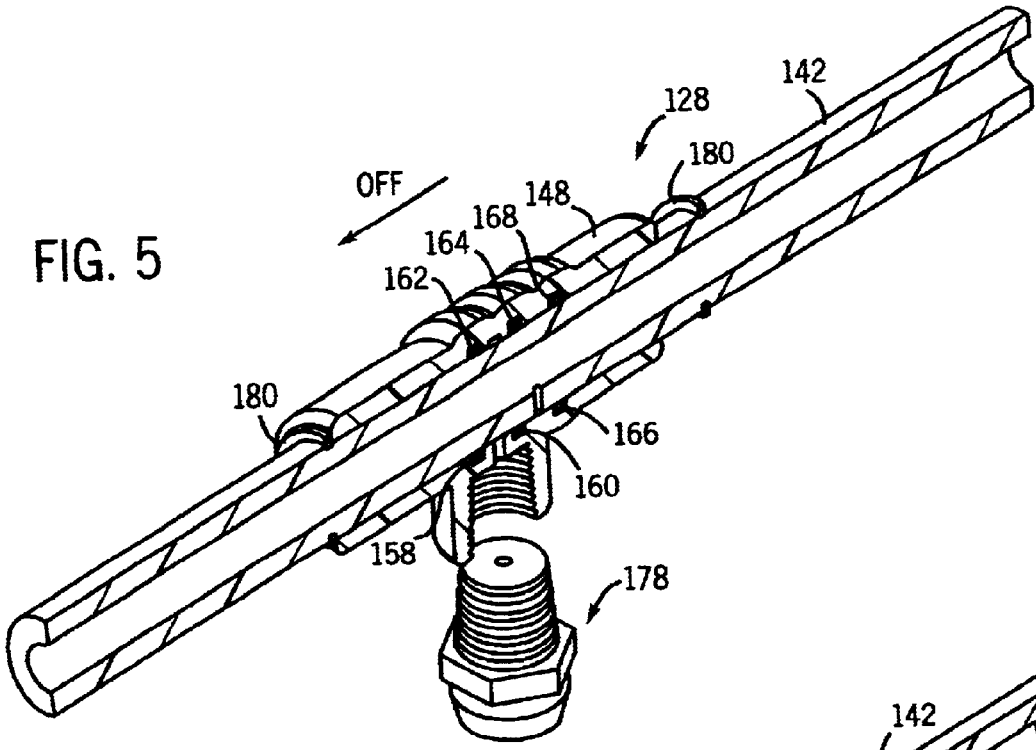
FIG. 5 is a perspective view of the misting system valve assembly in accordance with an alternative embodiment of the invention in a closed position.
Figure 6:
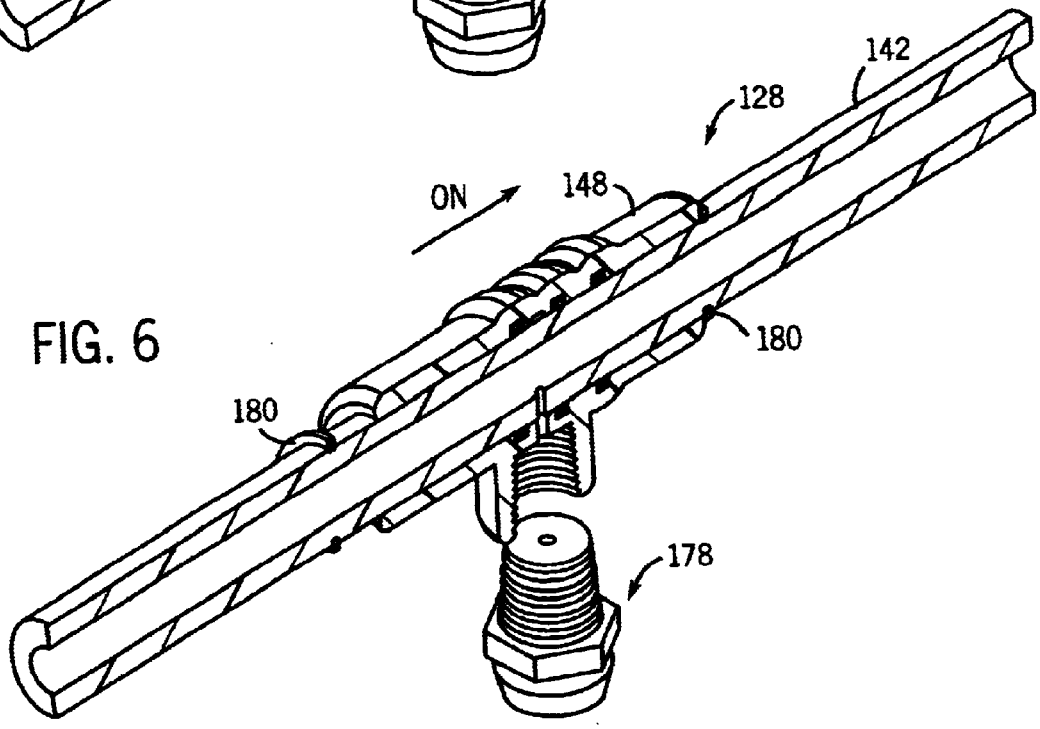
FIG. 6 is a perspective view of the misting system valve assembly of FIG. 5 in the open position.

Referring to FIGS. 5 and 6, a misting system 128 according to an alternative embodiment of the invention is illustrated. The misting system 128 includes a conduit 142, a nozzle holder 148 and a nozzle 178. Stops 180 are provided on the conduit 142. The misting system 128 of FIGS. 5 and 6 differs from the misting system 28, discussed above, in that O-rings 158, 160 and 166 are received in respective inwardly opening annular grooves 162, 164 and 168 in the nozzle holder 148. FIG. 5 illustrates the nozzle holder 148 in the closed position, while FIG. 6 illustrates the nozzle holder 148 in the open position.

Figure 7:
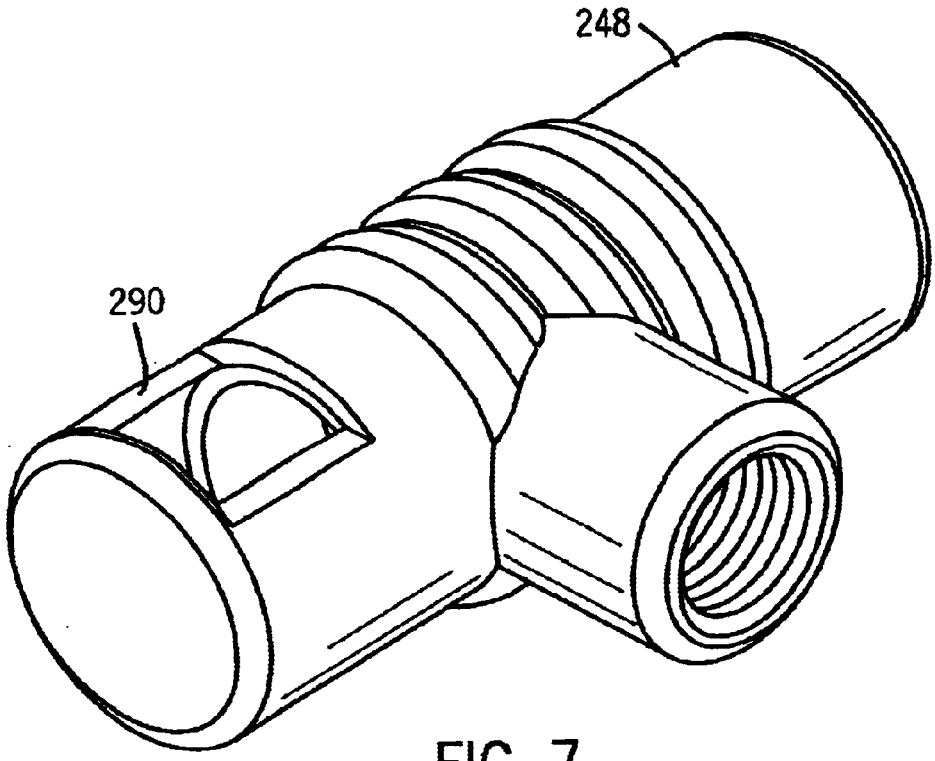
FIG. 7 is a perspective view of a nozzle holder in accordance with another embodiment of the invention.
Figure 8:
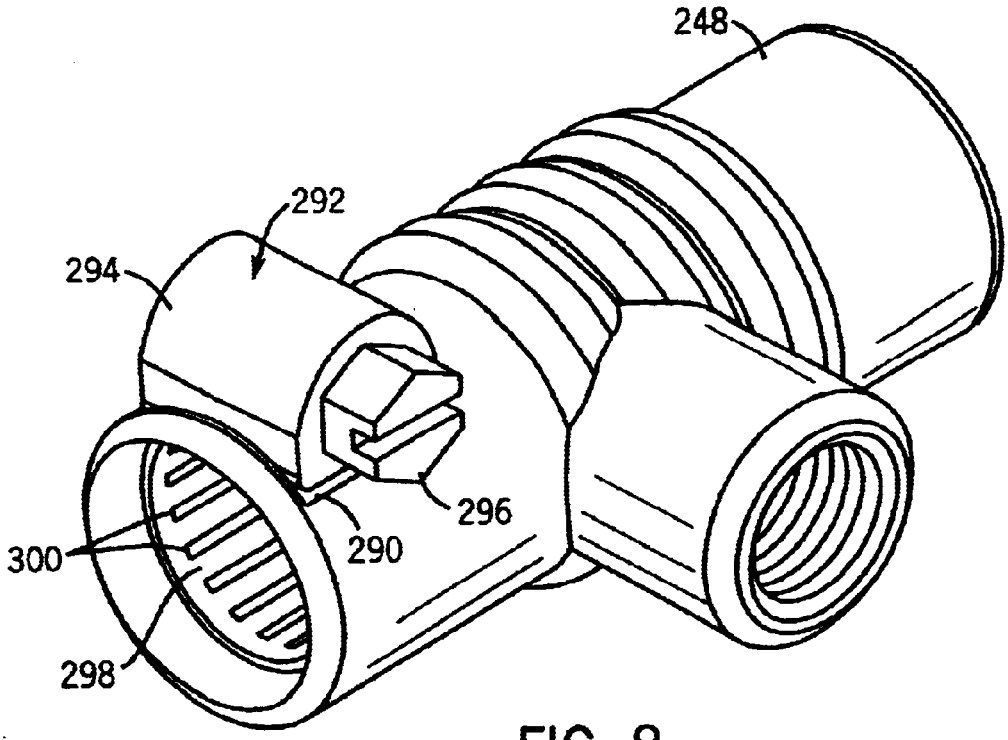
FIG. 8 is a perspective view of the nozzle holder of FIG. 7 with a locking clamp mounted thereon.

Referring to FIGS. 7 and 8, a nozzle holder 248 according to a further embodiment of the invention is illustrated. The nozzle holder 248 includes a rectangular notch 290 proximate one end, as shown in FIG. 7. The notch 290 provides an opening that exposes a conduit (not shown) that slidably receive the nozzle holder 248, as with the embodiments above. A worm gear type clamp 292, see FIG. 8, includes a head 294 receiving a screw 296. An elongate strap 298, including longitudinally spaced slots 300 extends inside the nozzle holder 248 with its ends received in the head 294, in a conventional manner. Turning the screw 296 causes threads of the screw 296 to engage the slots 300 to selectively loosen or tighten the metal strap 298. As a result, the nozzle holder 248 can be locked on the conduit by turning the clamp 292 closed with a screwdriver and unlocked by loosening the clamp, as is conventional. Particularly, locking is provided by the worm gear clamp locked on the conduit to prevent slidable movement or rotary movement of the nozzle holder 248. This can be used to lock the nozzle head 248 in either the open position or closed position or in any select rotary position. In order to change the position, it is then necessary to loosen the clamp in the conventional manner.

Thus, in accordance with the invention, there is provided a misting system nozzle holder with a manual slide shut-off valve operation.

I claim:

1. A misting system valve assembly comprising:

a conduit connectable to a pressurized fluid supply, the conduit including a through opening;

a sleeve telescopically received on the conduit, the sleeve being adapted to support a nozzle, the sleeve having a sleeve opening therethrough for selectively delivering pressurized fluid to the nozzle, the sleeve being moveable on the conduit between an open position where the conduit through opening is in communication with the sleeve opening and a closed position where the conduit through opening is not in communication with the sleeve opening; and an annular outwardly opening groove in the conduit and the conduit through opening opens into the groove.

2. The misting system valve assembly of claim 1 wherein the conduit and the sleeve are cylindrical.

3. The misting system valve assembly of claim 1 further comprising a pair of O-rings on either side of the through opening.

4. The misting system valve assembly of claim 3 wherein the O-rings are received in annular grooves in the conduit.

5. The misting system valve assembly of claim 3 wherein the O-rings are received in annular grooves in the sleeve.

6. The misting system valve assembly of claim 1 further comprising stop means for limiting axial movement of the sleeve on the conduit.

7. The misting system valve assembly of claim 1 further comprising stop means for preventing rotary movement of the sleeve on the conduit.

8. The misting system valve assembly of claim 7 wherein the stop means comprises an element protruding outwardly from the conduit and receivable in an axially extending groove in the sleeve.

9. The misting system valve assembly of claim 1 wherein the sleeve further comprises an adapter extending radially therefrom for removably receiving a nozzle.

10. A misting system valve assembly comprising:

a conduit connectable to a pressurized fluid supply, the conduit including a through opening;

a sleeve telescopically received on the conduit, the sleeve being adapted to support a nozzle, the sleeve having a sleeve opening therethrough for selectively delivering pressurized fluid to the nozzle, the sleeve being moveable on the conduit between an open position where the conduit through opening is in communication with the sleeve opening and a closed position where the conduit through opening is not in communication with the sleeve opening; and stop means for limiting axial movement of the sleeve on the conduit, wherein the stop means comprises retaining clips mounted to the conduit on opposite sides of the through opening.

11. A misting system valve assembly comprising:

a conduit connectable to a pressurized fluid supply, the conduit including a through opening;

a sleeve telescopically received on the conduit, the sleeve being adapted to support a nozzle, the sleeve having a sleeve opening therethrough for selectively delivering pressurized fluid to the nozzle, the sleeve being moveable on the conduit between an open position where the conduit through opening is in communication with the sleeve opening and a closed position where the conduit through opening is not in communication with the sleeve opening; and stop means for limiting rotary movement of the sleeve on the conduit comprising an element protruding outwardly from the conduit and receivable in an axially extending groove in the sleeve wherein the element comprises a ball bearing receivable in a depression in the conduit.

12. A misting system valve assembly comprising:

a conduit connectable to a pressurized fluid supply, the conduit including a through opening;

a sleeve telescopically received on the conduit, the sleeve being adapted to support a nozzle, the sleeve having a sleeve opening therethrough for selectively delivering pressurized fluid to the nozzle, the sleeve being moveable on the conduit between an open position where the conduit through opening is in communication with the sleeve opening and a closed position where the conduit through opening is not in communication with the sleeve opening; and a worm gear type clamp received in a notch in the sleeve to selectively prevent movement of the sleeve on the conduit.

13. A misting system comprising:

an elongate conduit connectable to a pressurized fluid supply, the conduit including a plurality of longitudinally space through openings;

a plurality of slide shut off valves mounted to the conduit, each shut off valve comprising a sleeve telescopically received on the conduit proximate an associated one of the through openings and an adapter extending outwardly from the sleeve, the adapter to support a nozzle, each sleeve having a sleeve opening therethrough for selectively delivering pressurized fluid to the nozzle, each sleeve being moveable on the conduit between an open position where the associated conduit through opening is in communication with the sleeve opening and a closed position where the associated conduit through opening is not in communication with the sleeve opening; and a plurality of annular outwardly opening grooves in the conduit and each conduit through opening opens into one of the grooves.

14. The misting system of claim 13 wherein the conduit and the sleeves are cylindrical.

15. The misting system of claim 13 further comprising a pair of O-rings on either side of each through opening.

16. The misting system of claim 15 wherein the O-rings are received in annular grooves in the conduit.

17. The misting system of claim 15 wherein the O-rings are received in annular grooves in the sleeve.

18. The misting system of claim 13 further comprising stop means for limiting axial movement of each valve on the conduit.

19. The misting system of claim 13 further comprising stop means associated with each valve for limiting rotary movement of each valve on the conduit.

20. The misting system of claim 19 wherein each stop means comprises an element protruding outwardly from the conduit and receivable in an axially extending groove in the sleeve.

21. The misting system of claim 13 wherein each adapter removably receives a nozzle.

22. A misting system comprising:

an elongate conduit connectable to a pressurized fluid supply, the conduit including a plurality of longitudinally space through openings;

a plurality of slide shut off valves mounted to the conduit, each shut off valve comprising a sleeve telescopically received on the conduit proximate an associated one of the through openings and an adapter extending outwardly from the sleeve, the adapter to support a nozzle, each sleeve having a sleeve opening therethrough for selectively delivering pressurized fluid to the nozzle, each sleeve being moveable on the conduit between an open position where the associated conduit through opening is in communication with the sleeve opening and a closed position where the associated conduit through opening is not in communication with the sleeve opening; and stop means for limiting axial movement of each valve on the conduit, wherein the stop means comprises retaining clips mounted to the conduit on opposite sides of each through opening.

23. A misting system comprising:

an elongate conduit connectable to a pressurized fluid supply, the conduit including a plurality of longitudinally space through openings;

a plurality of slide shut off valves mounted to the conduit, each shut off valve comprising a sleeve telescopically received on the conduit proximate an associated one of the through openings and an adapter extending outwardly from the sleeve, the adapter to support a nozzle, each sleeve having a sleeve opening therethrough for selectively delivering pressurized fluid to the nozzle, each sleeve being moveable on the conduit between an open position where the associated conduit through opening is in communication with the sleeve opening and a closed position where the associated conduit through opening is not in communication with the sleeve opening; and stop means associated with each valve for limiting rotary movement of each valve on the conduit, wherein each stop means comprises an element protruding outwardly from the conduit and receivable in an axially extending groove in the sleeve, wherein each element comprises a ball bearing receivable in a depression in the conduit.

24. A misting system comprising:

an elongate conduit connectable to a pressurized fluid supply, the conduit including a plurality of longitudinally space through openings;

a plurality of slide shut off valves mounted to the conduit, each shut off valve comprising a sleeve telescopically received on the conduit proximate an associated one of the through openings and an adapter extending outwardly from the sleeve, the adapter to support a nozzle, each sleeve having a sleeve opening therethrough for selectively delivering pressurized fluid to the nozzle, each sleeve being moveable on the conduit between an open position where the associated conduit through opening is in communication with the sleeve opening and a closed position where the associated conduit through opening is not in communication with the sleeve opening; and wherein each slide shut-off valve further comprises a worm gear type clamp received in a notch in the sleeve to selectively prevent movement of the sleeve on the conduit.

* * * * *